United States Patent [19]

Naevestad

[11] 4,427,494

[45] Jan. 24, 1984

[54] CHUCK DOOR FOR COKE OVEN PUSHER SIDE DOOR AND HEAT RADIATION SHIELD

[75] Inventor: Roy Naevestad, Fanwood

[73] Assignee: Krupp Wilputte Corporation, Murray Hill, N.J.

[21] Appl. No.: 350,054

[22] Filed: Feb. 18, 1982

Related U.S. Application Data

[62] Division of Ser. No. 234,965, Feb. 17, 1981, Pat. No. 4,372,820.

[51] Int. Cl.[3] ..... C10B 25/06; C10B 25/16

[52] U.S. Cl. ..... 202/248; 202/269

[58] Field of Search ..... 202/242, 247, 248, 269

[56] References Cited

U.S. PATENT DOCUMENTS

| | | | |
|---|---|---|---|
| 2,442,349 | 11/1945 | Exum | 202/248 |
| 2,698,289 | 4/1953 | Wolff | 202/248 |
| 2,780,590 | 2/1957 | Doll | 202/248 |
| 2,993,845 | 7/1958 | Coe | 202/248 |
| 3,519,256 | 3/1968 | Heisterkamp | 202/248 |
| 3,567,590 | 1/1969 | Reinfeld et al. | 202/248 |
| 3,933,598 | 1/1976 | Pries | 202/248 |
| 3,974,038 | 8/1976 | Tucker | 202/248 |
| 3,990,950 | 11/1976 | Carr | 202/248 |
| 3,996,110 | 10/1976 | Campana | 202/248 |
| 4,002,537 | 1/1977 | Calderon | 202/248 |
| 4,028,193 | 6/1977 | Nagayoshi | 202/248 |
| 4,036,702 | 7/1977 | Nagayoshi | 202/248 |
| 4,086,145 | 4/1978 | Muller | 202/248 |
| 4,216,062 | 8/1980 | Kelly et al. | 202/269 |
| 4,290,372 | 9/1981 | Sato | 202/248 |

FOREIGN PATENT DOCUMENTS

| | | | |
|---|---|---|---|
| 714260 | 8/1954 | United Kingdom | 202/248 |
| 824035 | 11/1959 | United Kingdom | 202/248 |

*Primary Examiner*—Bradley Garris

*Attorney, Agent, or Firm*—Buell, Blenko, Ziesenheim & Beck

[57] ABSTRACT

The invention is a new design of chuck door which has a knife-edge sealing strip that fits tightly in a slot of the door and is adjustable longitudinally by jacking screws. The strip is locked in position also by screws. The inside of the chuck door is provided with a cavity within which heat insulating refractory material is retained. A pivoted heat shield hangs from extended side heat shields in the coke oven and pivots up to allow entry of the leveler bar through the opening closed by the chuck door. The design is readily adaptable to new and to existing oven doors.

5 Claims, 11 Drawing Figures

CHUCK DOOR FOR COKE OVEN PUSHER SIDE DOOR AND HEAT RADIATION SHIELD

This is a division of application Ser. No. 234,965, filed Feb. 17, 1981 now U.S. Pat. No. 4,372,820.

This invention relates to a chuck door for a coke oven having an adjustable sealing edge strip to eliminate smoke emissions and a pivoted heat shield which does not interfere with insertion of the leveler bar into the coke oven chamber.

Some present day chuck doors do not seal properly on the coke oven door to which they are hinged and as a result smoke is emitted past the chuck door during the coking cycle. Also oven chamber heat causes present designs of chuck doors to warp or the compression springs to fail. When a chuck door warps, the sealing strip edge is no longer in uniform contact with the jamb seating surface or when the spring compression is reduced due to excessive oven heat, the contact sealing pressure between the chuck door seal surface and the jamb sealing surface is reduced. In such case, the chuck door seal fails and smoke from the coke oven is emitted past the chuck door.

In order to eliminate smoke emission past the chuck door, I provide a knife-edge sealing strip that is retained in a slot in the door and is adjustable by means of jacking screws enabling the knife-edges to be adjusted to eliminate smoke emissions during full scale operation of the coke oven. Moreover, in order to reduce the heat to which the chuck door is exposed and reduce the exposure of the door compression spring to the heat of the coke oven, I provide a pivoted heat shield which will swing upwardly to an open position as the leveler bar travels into the coke oven chamber to level the coal. Incidentally, when the leveler bar is withdrawn, the pivoted heat shield provides added safety for the pusher operator since it will effectively block the flame flash back from the chuck door in the event the standpipes are partially blocked or the oven top service crew has turned off the aspirating steam.

Moreover, I provide extended side heat shields to support the pivoted heat shield and incidentally block some of the radiated heat from the oven walls that would normally impinge on the interior side of the chuck door. The extended side heat shields also serve to reduce the amount of coal that spills over the oven door plug and falls between the door plug and the oven wall when the leveler bar is withdrawn, thus reducing the amount of carbon build-up on the side of the oven wall and also the side of the oven door plug.

The above improvements and others which will become apparent later on, are hereinafter more fully described in connection with the accompanying drawings, wherein.

Figure 2:
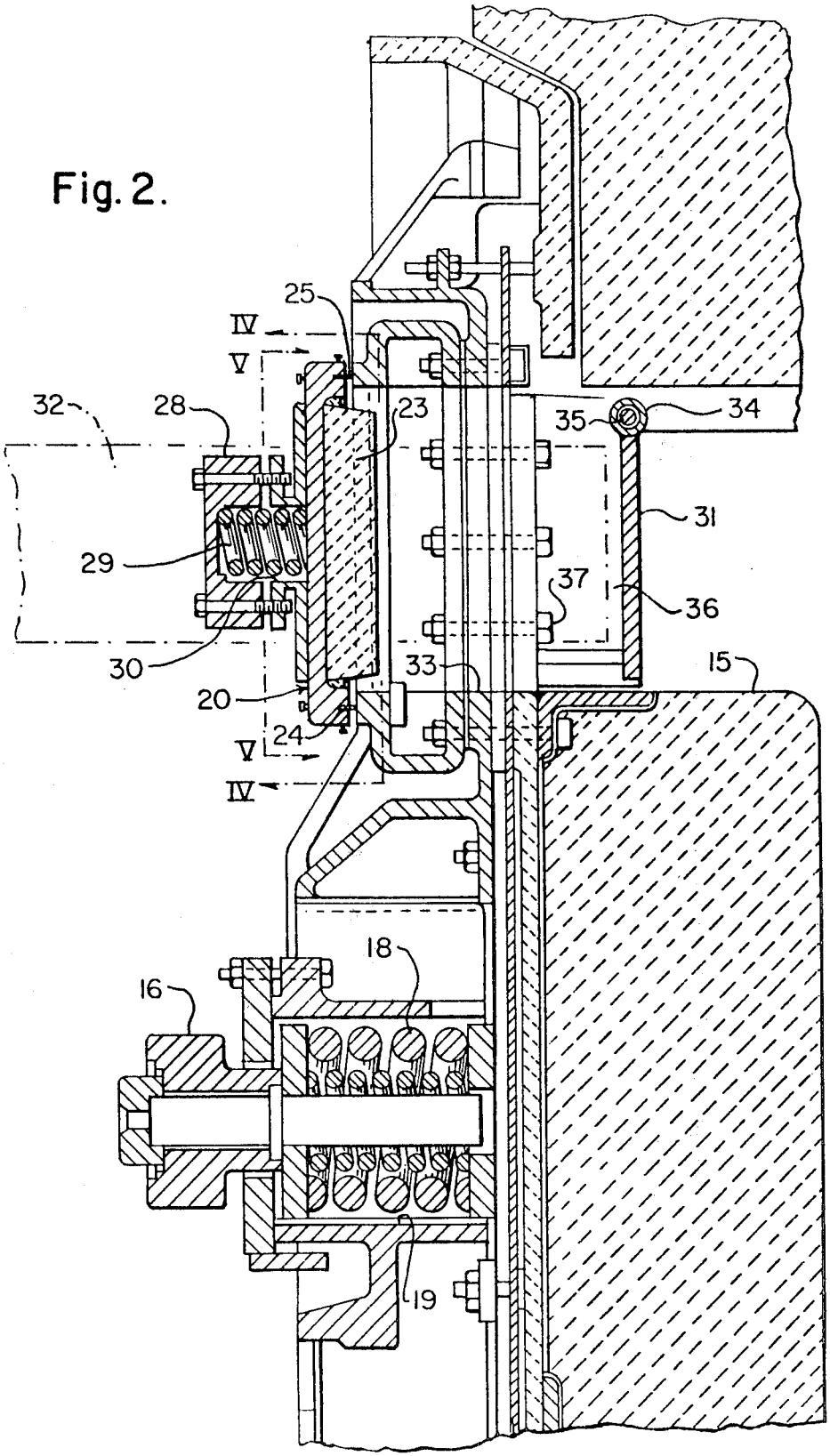
FIG. 2 is a vertical sectional view taken on the line II—II FIG. 1.
Figure 3:
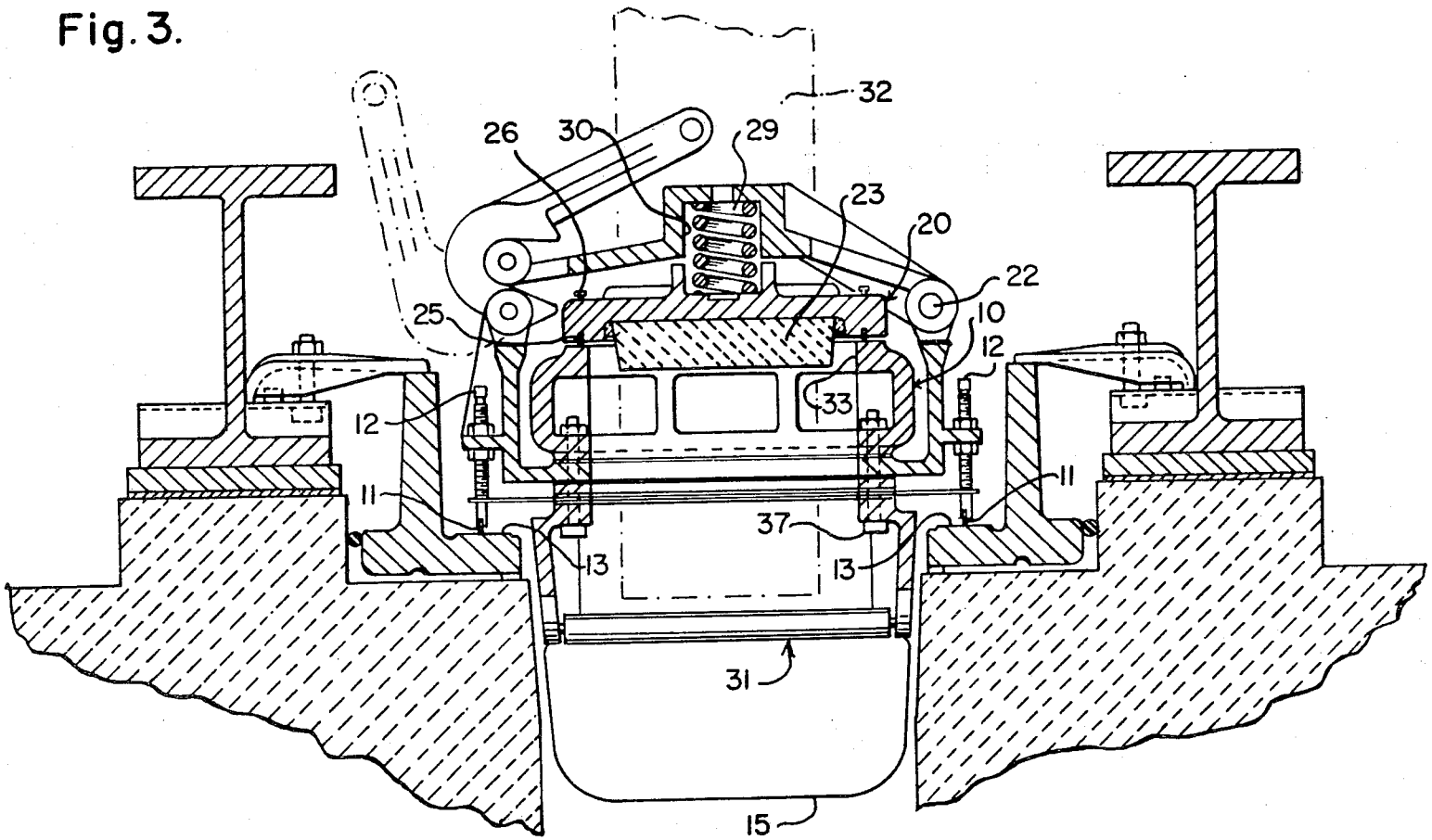
FIG. 3 is a horizontal sectional view taken on the line III—III of FIG. 1.
Figure 5:
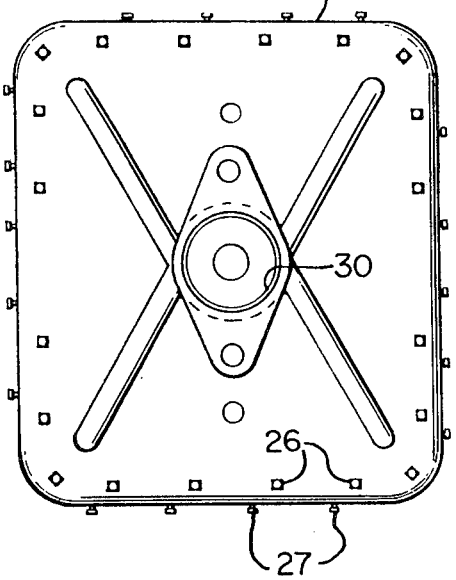
FIG. 5 is a view, taken on the line V—V of FIG. 2, showing the back of the chuck door.
Figure 7:
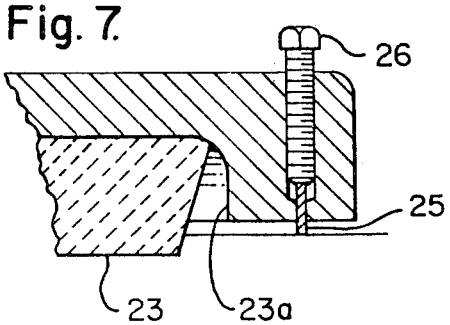
FIG. 7 is a fragmentary enlarged sectional view, showing the screws for adjusting the position of the sealing strips.
Figure 6:
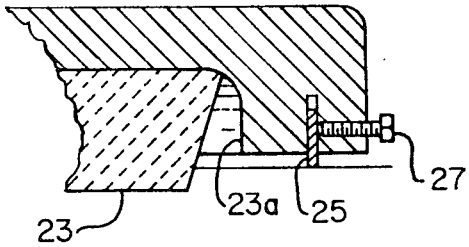
FIG. 6 is a fragmentary enlarged sectional view, showing the grooves or slots in the chuck door in which the sealing strips are sealed and the screws for locking them in place.

Referring to the drawings, especially FIGS. 1, 2 and 3 the essential structure of the coke oven and the coke oven door and the relation of the chuck door to the coke oven door will now be described.

The coke oven door 10 has a sealing strip 11 adjustable by screws 12 into seating relation on a jamb surface 13. The door 10 has a centering member 14 and a heat insulating door plug 15 of refractory material carried on the back thereof. On the front of the oven door 10 is a swiveled door latch member 16 which engages in slots of slotted members 17 on opposite sides of the door. As shown in FIG. 2, the door latch compresses a coil spring 18 in a recess 19 of the door to yieldingly press the door into sealing contact with the jamb.

The chuck door 20 which is fabricated of high temperature casting material or steel is hinged to the oven door 10 on a vertical rod 22 and carries a refractory member 23 in a recess 23*a* in the face of the door to protect the door against excessive heat that could cause warping. The refractory member 23 is suitably held or anchored in the recess 23*a*.

The face of the chuck door has a peripheral groove 24 and carries a knife-edge sealing strip 25 which is hammered tightly, that is impacted into the groove. A series of adjusting screws or jacks 26, serve to adjust the sealing strip 25 during oven operation. A series of screws 27 engage the side of the sealing strip to press it against the side of the slot to lock it in place after it is adjusted by screws 26.

Figure 8:
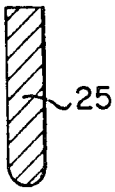
Figure 10:
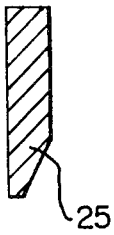

The sealing strip 25 may have a rounded sealing edge, as in FIG. 8, or a beveled knife-edge as shown in FIG. 10.

Figure 4:
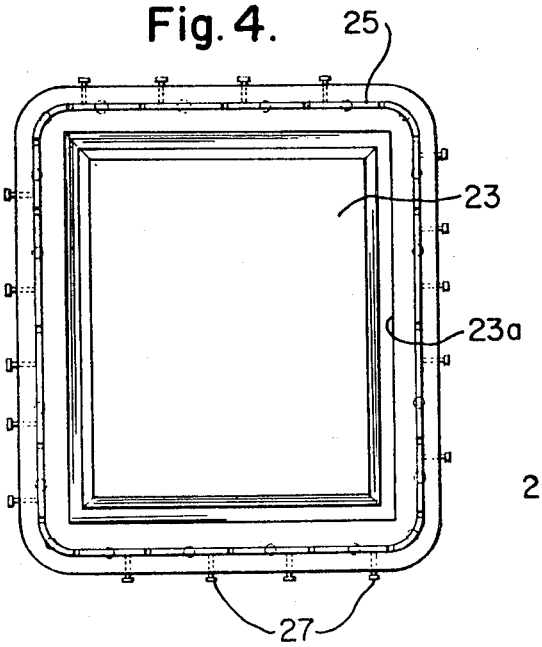
FIG. 4 is a view, taken on the line IV—IV of FIG. 2, showing the inside sealing face of the chuck door.
Figure 9:
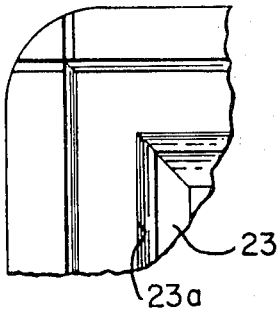
FIGS. 8 and 9 are fragmental enlarged views showing a cross-section of one form of sealing strip and a mitred joint thereof in the groove.
Figure 11:
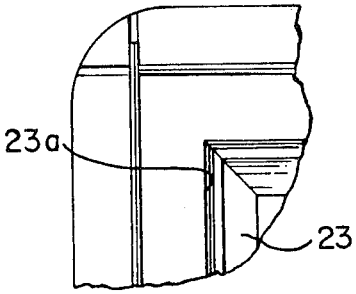
FIGS. 10 and 11 are fragmental enlarged views showing a cross-section of another form of sealing strip and the manner in which it is fitted into the groove in the door.

The sealing strip 25 may be rounded at the corners as shown in FIG. 4, or the sections of the sealing strip may be mitred at the corners as shown in FIG. 9. Also the sections of the sealing strip, at right-angles to each other, may simply make butting contact at the corners, as shown in FIG. 11. The inner edge of the sealing strip 25 may be slit or slotted at intervals to enable closer conformity to the jamb surface.

Figure 1:
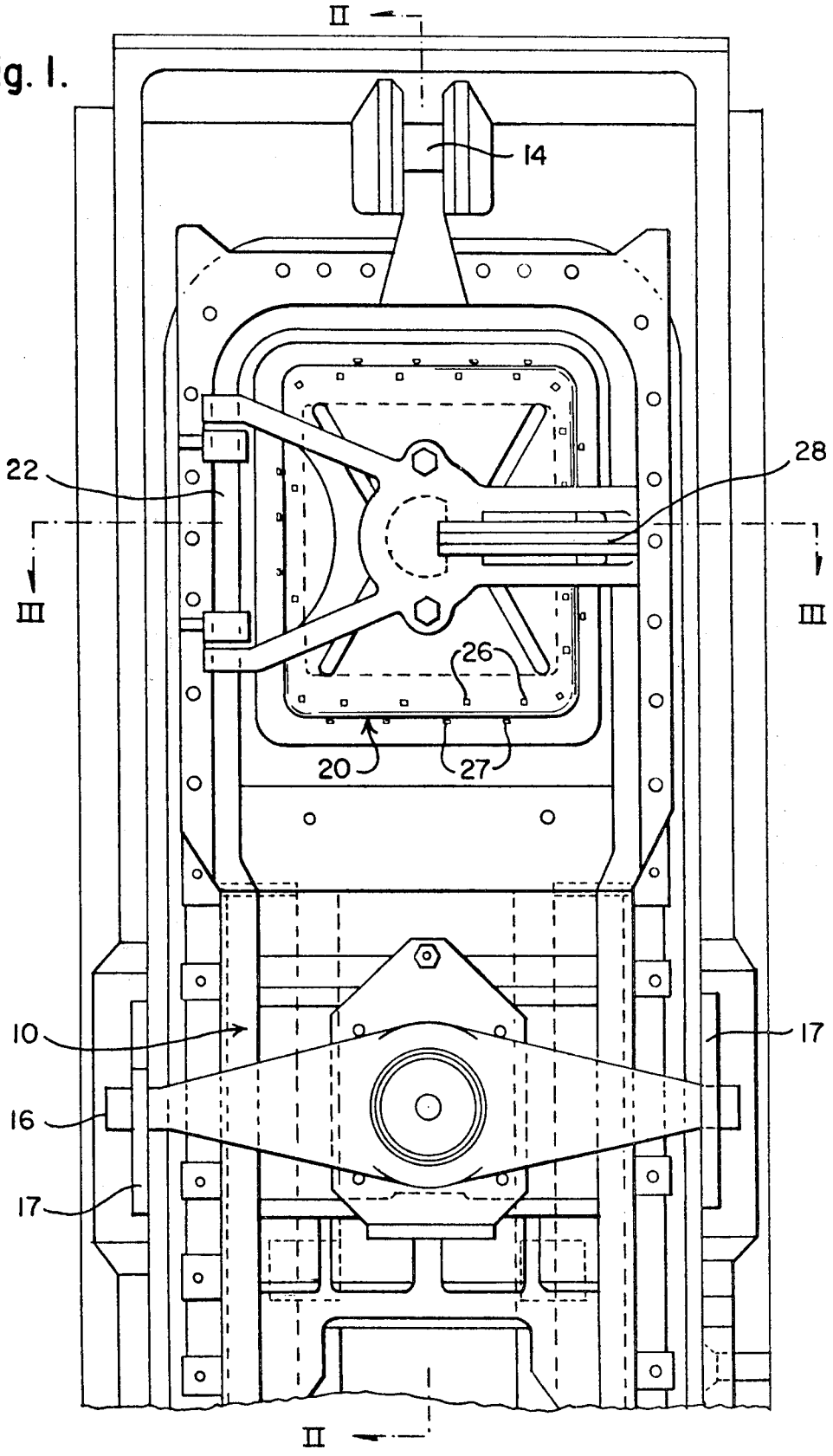
FIG. 1 is a partial front view of a coke oven battery showing the coke oven pusher side door and the location of the chuck door therein.

As seen particularly in FIG. 1, the chuck door 20 has a latch bar 28 which compresses a coil spring 29 seated in a circular recess 30 in the face of the chuck door to exert a yielding pressure urging the chuck door to its seated position.

In order to reduce the heat to which the inside surface of the chuck door is exposed I provide a pivoted heat shield 31 that is swung up automatically as the leveler bar 32 (shown in chain lines in FIG. 3) is inserted through the opening 33 of the chuck doorway. The chuck door is so swiveled at the rod 22 that it can be swung to clear the opening 33 for the leveler bar 32.

The pivoted heat shield 31 is a suitable sheet of steel having a pipe or tube 34 attached integrally thereto, as by welding, through which a rod 35 extends. The rod 35 is anchored at opposite ends in suitable slots in the side heat shields 36. The side heat shields 36 are L-shaped and are attached by bolts 37 through the flanges thereof to the oven door.

On withdrawal of the leveler bar 32,the pivoted heat shield 31 drops down into contact with the inside ends of the side heat shields 36, thus effectively blocking the flame flash back from the chuck door which could occur in the event that the standpipes are partially blocked or the oven top service crew has turned off the oven aspirating steam.

It will be apparent that the side heat shields 36 will reduce the amount of coal that spills over the door plug 15 when the leveler bar 32 is withdrawn, thus reducing the amount of carbon build-up on the side of the oven wall and also on the side of the oven door plug.

It will be seen that the chuck door which I have provided for the coke oven pusher side door is capable of greatly reducing, if not eliminating, the escape of smoke therepast from the coke oven chamber by greatly improving the seal of the chuck door on the jamb therefor on the oven door.

Also, it will be seen that the pivoted heat shield which I suspend from the side heat shields serves to reduce the exposure of the chuck door to the heat of the coke oven as well as preventing flame flash back from the chuck door as before mentioned.

Moreover, while I have described a new design of sealing strip for the chuck door only it will be apparent that the coke oven doors, both on the pusher side and on the coke side, may also be equipped with a similar arrangement of sealing strip to further assist in preventing leakage of smoke therepast.

I claim:

1. A chuck door of generally rectangular shape for closing a leveling opening in a main door through which coke is pushed out of the coking chamber of a coke oven battery, said chuck door being of steel, movably mounted so as to engage a seat on said main door, and having knife edge sealing means for engaging said seat on said main door in surrounding relation to said leveling opening, said chuck door having a slot of generally rectangular cross section in the face thereof surrounding the leveling opening in said main door when the chuck door is sealed thereon and a flat knife edge sealing strip tightly fitted in said slot and driven therein by impaction, first screw means engaged in tapped holes in the chuck door and contacting the knife edge strip at intervals along its edge in said slot to adjust the sealing strip to closely conform to the seat on said main door, and second screw means engaged in tapped holes in the chuck door and contacting the sealing strip at intervals along its side to press it laterally against the side of said slot and lock it in an adjusted position.

2. A chuck door according to claim 1 wherein the said slot therein is made up of a series of straight sections connected by curved sections at the corners so that the sealing strips when butted together end-to-end form a continuous sealing surface.

3. A chuck door according to claim 1 wherein the slot therein is made up of a series of intersecting straight sections and sealing strips in adjacent sections of the slot are joined by butting contact.

4. A chuck door according to claim 1 wherein the slot therein is made up of a series of straight sections intersecting at the corners of the chuck door, and the sealing strips in said straight sections are connected by a mitered joint at the corners of the chuck door.

5. A chuck door according to claim 1 in which the knife edge sealing strip is formed with slots extending from its inner edge, whereby said sealing strip conforms closely to the seat on said main door.

* * * * *